US006801111B2

(12) United States Patent
Siebels et al.

(10) Patent No.: US 6,801,111 B2
(45) Date of Patent: Oct. 5, 2004

(54) LATCH FOR AN ELECTRICAL DEVICE

(75) Inventors: Randall L. Siebels, Cedar Rapids, IA (US); Scott A. Mickelson, Cedar Rapids, IA (US); Ardean G. Schill, Cedar Rapids, IA (US); Frank T Ehrenberger, Swisher, IA (US); Elizabeth A. Billings, Mechanicsville, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/225,001

(22) Filed: Aug. 21, 2002

(65) Prior Publication Data

US 2004/0036562 A1 Feb. 26, 2004

(51) Int. Cl.[7] ..... H01H 9/02
(52) U.S. Cl. ..... 335/167; 335/35; 335/172
(58) Field of Search ..... 335/23–25, 35–42, 335/165–176

(56) References Cited

U.S. PATENT DOCUMENTS

| | | | | |
|---|---|---|---|---|
| 2,902,560 A | * | 9/1959 | Stanback et al. | 335/25 |
| 3,246,098 A | * | 4/1966 | Hall | 335/35 |
| 3,760,308 A | * | 9/1973 | Misencik et al. | 335/35 |
| 4,929,919 A | * | 5/1990 | Link et al. | 335/38 |
| 5,245,302 A | | 9/1993 | Brune et al. | 335/35 |
| 5,250,918 A | * | 10/1993 | Edds et al. | 335/35 |
| 5,294,901 A | * | 3/1994 | Tacinelli et al. | 335/35 |
| 5,430,419 A | | 7/1995 | Scheel et al. | 335/16 |
| 5,817,998 A | | 10/1998 | Siebels et al. | 200/43.14 |
| 5,864,266 A | | 1/1999 | Mickelson et al. | 335/35 |
| 6,232,860 B1 | * | 5/2001 | Acevedo et al. | 335/167 |

FOREIGN PATENT DOCUMENTS

| | | |
|---|---|---|
| DE | 35 45 490 A | 7/1987 |
| DE | 44 13 785 A | 12/1994 |
| DE | 199 40 370 A | 3/2001 |

* cited by examiner

*Primary Examiner*—Lincoln Donovan
(74) *Attorney, Agent, or Firm*—Larry I. Golden

(57) ABSTRACT

An electrical device, such as a circuit breaker, for interrupting the flow of current, which includes a stationary contact, a blade having a movable contact, a releasably latchable trip lever, a bimetal, and a magnetic armature. The movable contact is movable into and out of engagement with the stationary contact. The trip lever is releasable from a latched position for movement to a tripped position to cause separation of the stationary and movable contacts. The bimetal causes the release of the trip lever from the latched position by having the armature drawn a predetermined distance in response to a predetermined short circuit current. The trip lever is held in the latched positioned by a hardened latch having a minimal surface area, which is positioned near an opening located in the armature. When the predetermined short circuit current flows through the bimetal, the trip lever moves to the tripped position.

21 Claims, 3 Drawing Sheets

LATCH FOR AN ELECTRICAL DEVICE

FIELD OF THE INVENTION

This invention is directed generally to electrical devices and, more specifically, to a latching feature used in a current tripping mechanism for a circuit breaker.

BACKGROUND OF THE INVENTION

Electrical devices, such as circuit breakers, are widely used in diverse residential, commercial, and industrial electric systems, being indispensable components of such systems in protecting against over-current conditions. In response to application-specific needs, such as space constraints, efficiency, capacity, response time, and type of reset function (manual or remote), a multitude of different circuit breakers have been developed.

One type of circuit breaker that has been developed uses a thermo-magnetic tripping device to trip a latch in response to a specific range of over-current conditions. One feature of this type of circuit breaker is an electromagnet arrangement that includes a yoke and an armature. In the presence of a very high current, or short circuit condition, the yoke and armature are attracted to each other to release the latch and cause a tripping condition, which results in the interruption of current flow through the electrical system associated with the circuit breaker. Another feature of this type of circuit breaker is a bimetal arrangement that comprises a bimetal element and a trip lever. A function of the bimetal arrangement is to trip the circuit breaker by causing a significant deflection in the bimetal element, which responds to changes in temperature due to resistance heating caused by the flow of the circuit's electric current through the bimetal. Typically, the bimetal element is in the form of a blade and it operates together with a latch. Heating the bimetal to a predetermined level causes it to deflect and to release the trip lever from the latch after a time delay that corresponds to a predetermined over-current threshold. Consequently, the current circuit that is associated with the bimetal is broken.

The latch is generally a flat piece of metal, such as a stainless steel plate, that is installed on the armature and that functions to hold the trip lever in the tripped position until a predetermined condition occurs, such as the manual resetting of the circuit breaker. The latch is usually hardened to provide a wear resistant surface, and is typically greased to reduce friction between the trip lever and the latch. During the normal operation of the circuit breaker debris is created that is caught in the grease on the latch surface. The movement of the trip lever between a latched and a tripped position can pull the debris along the surface of the latch plate and damage the surface of the latch. An undesired effect of a damaged latch surface is that a higher than normal unlatching force may be required. Therefore, to avoid damage the latch surface requires frequent cleaning. Another undesired effect of a damaged latch surface is that the circuit breaker may possibly malfunction, wherein debris lodged between the latch and the trip lever could prevent any further movement of the trip lever and make the circuit breaker inoperable.

Accordingly, there is a need for an improved circuit breaker that avoids the above mentioned problems.

SUMMARY OF THE INVENTION

Briefly, in accordance with the foregoing, the invention relates to an electrical device, such as a circuit breaker, for interrupting the flow of current, which comprises a housing, a stationary contact, a blade having a movable contact, a releasably latchable trip lever, a bimetal, and a magnetic armature. The movable contact is movable into and out of engagement with the stationary contact, and the trip lever, which is pivotally mounted in the housing, is releasable from a latched position for movement to a tripped position to cause separation of the stationary and movable contacts. The bimetal causes the release of the trip lever from the latched position by having the magnetic armature, which is pivotally connected to the bimetal, drawn a predetermined distance in response to a predetermined short circuit current flowing through the bimetal. The trip lever is held in the latched positioned by a latch which is positioned near an opening located in the magnetic armature. The latch is made of a hardened, relative to the armature, material and it has a minimal surface area. When the predetermined short circuit current flows through the bimetal, the trip lever moves to the tripped position.

Figure 1:
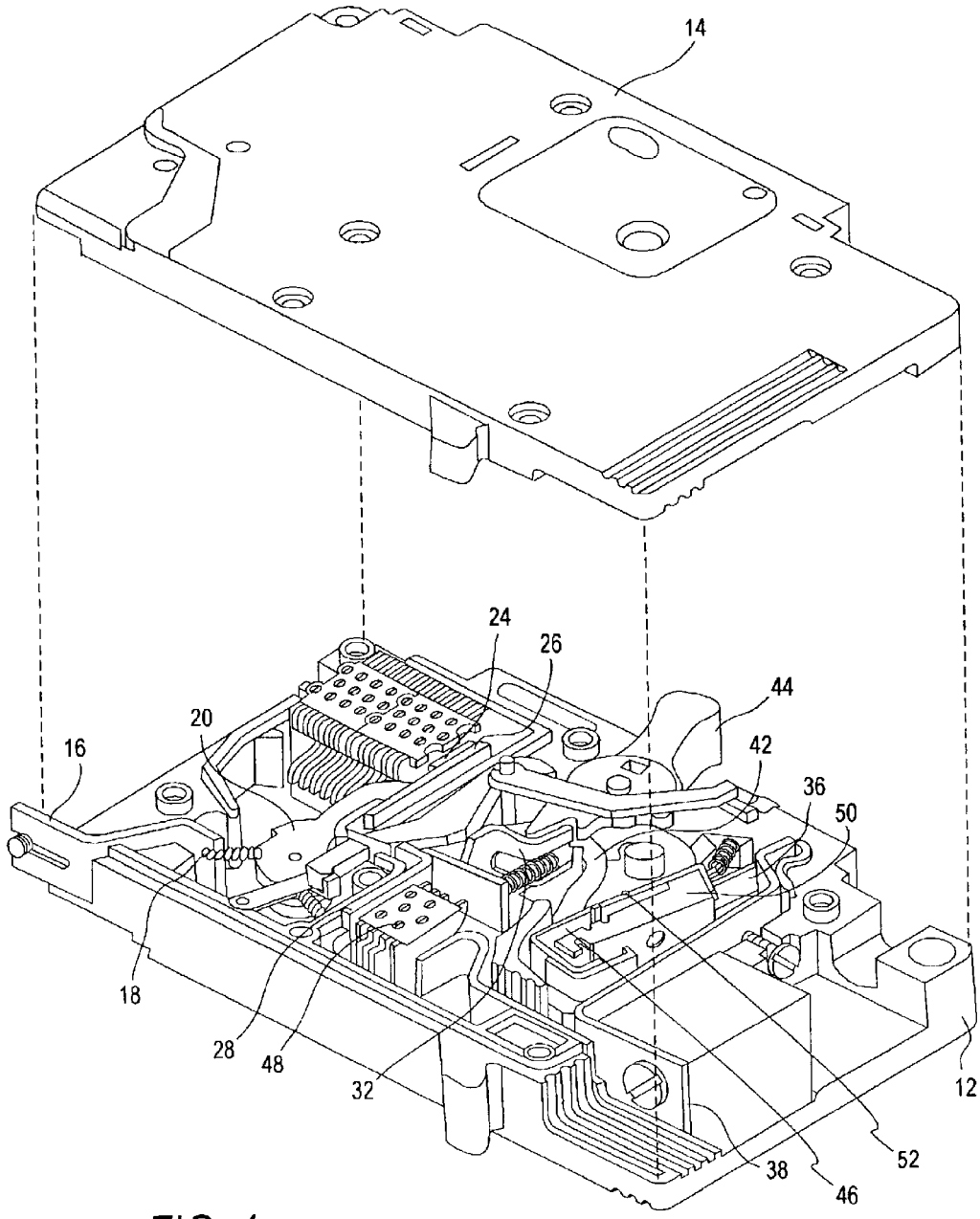
FIG. 1 is a perspective view of a circuit breaker including a latching arrangement embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENT

Figure 2:
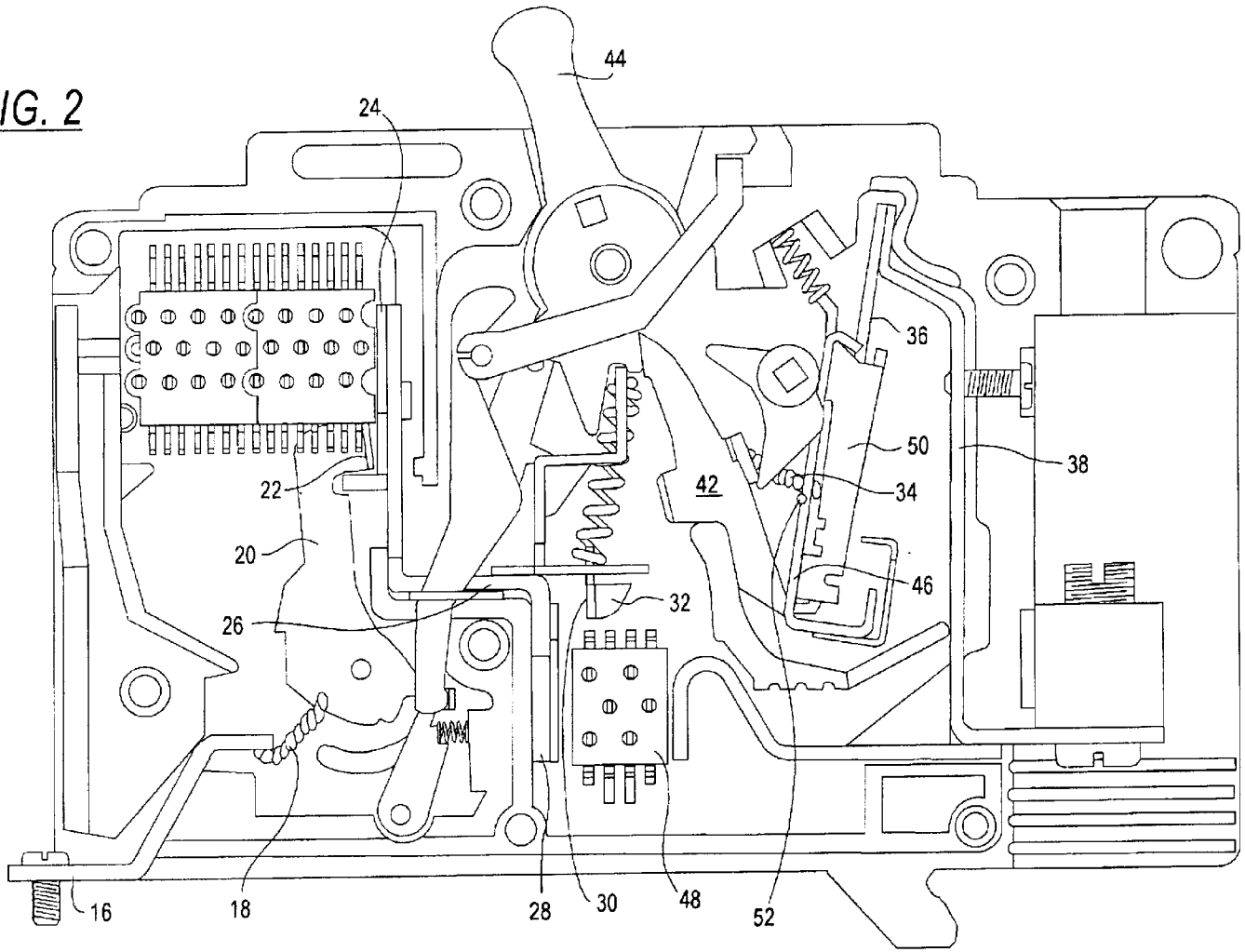
FIG. 2 is a side view of the circuit breaker shown in FIG. 1.

Referring now to the drawings, FIGS. 1 and 2 illustrate a circuit breaker having an armature with an improved latch arrangement for preventing debris from interfering with the normal operation of the circuit breaker, and, in particular, with the movement of a trip lever between a tripped position and a latched position. Although the present invention can be used with other electrical devices, such as a switch, the description will refer to a circuit breaker for exemplary purposes. The improved latch arrangement will be described in detail below following a brief description of the overall operation of an exemplary circuit breaker.

The circuit breaker includes a housing that comprises a base 12 and a corresponding cover 14. In general, the components of the circuit breaker are affixed to the base 12. The current path through the circuit breaker begins at a line terminal 16, and from the line terminal 16 the current path goes through a secondary flexible connector 18. In turn, the secondary flexible connector 18 is attached to a secondary blade 20 having a secondary moveable contact 22 (shown in FIG. 2) mating with a secondary stationary contact 24. Current flows through the secondary moveable and stationary contacts 22, 24 to a middle terminal 26 which is configured in an S form. The other side of the middle terminal 26 includes a primary stationary contact 28 connected thereto. Positioned opposite the primary stationary contact 28 is a mating primary moveable contact 30 (shown in FIG. 2) attached to a primary blade 32. Current flows through the primary stationary and moveable contacts 28, 30, through the primary blade 32, and into one end of a primary flexible connector 34 (shown in FIG. 2). The other end of the primary flexible connector 34 is attached to a bimetal 36, which provides the thermal tripping characteristics for the circuit breaker. Finally, the current flows from the bimetal 36 through a load terminal 38 and out of the load end of the circuit breaker.

The circuit breaker also includes a trip lever 42, a handle 44, a magnetic armature 46 (shown in FIG. 2), a primary arc stack 48, and a yoke 50. These components are used to implement the manual ON/OFF operation, the thermal-trip separation, and the electromagnetic trip separation of the primary stationary and moveable contacts 28, 30.

For further information regarding the overall construction and operation of the circuit breaker shown in FIGS. 1 and 2 reference may be made to circuit breakers having similar construction which are disclosed in U.S. Pat. No. 5,680,081, U.S. Pat. No. 5,498,847, U.S. Pat. No. 5,428,328, and U.S. Pat. No. 5,864,266, which are assigned to the current assignee and incorporated herein by reference.

Normal ON and OFF operation of the primary blade 32 occurs in response to rotation of the handle 44 in a clockwise or counterclockwise motion. In response to rotation of the handle 44 in either direction, the primary blade 32 either opens or closes the circuit through the primary moveable contact 30 and the primary stationary contact 28.

The illustrated circuit breaker utilizes magnetic and thermal trip protection features to interrupt overload and short circuit current conditions. The circuit breaker is ready to be tripped when the trip lever 42 is engaged or latched in an aperture in a magnetic armature 46. For example, the magnetic trip feature causes the movement of the trip lever 42 from a latched position to a tripped position. In response to a predetermined short circuit current flowing through the bimetal 36, the armature 46 is drawn a predetermined distance toward a yoke 50. This allows the trip lever 42 to disengage from the armature 46 and rotate in the clockwise direction, which, in turn, allows the primary blade 32 to rotate in the counterclockwise direction to the tripped position. In the tripped position the primary moveable contact 30 is separated from the primary stationary contact 28, resulting in the interruption of the current flow.

Similarly, the thermal trip feature causes the movement of the trip lever 42 from the latched position to the tripped position In response to a predetermined overload current flowing through the current path, the bimetal 36 heats up and deflects in the counter-clockwise direction to allow the trip lever 42 to disengage from the armature 46. followed by the same sequence of events as discussed above resulting in the primary moveable contact 30 separating from the primary stationary contact 28. Related tripping arrangements are shown in U.S. Pat. No. 2,902,560, U.S. Pat. No. 3,098,136, U.S. Pat. No. 4,616,199, U.S. Pat. No. 4,616,200, and U.S. Pat. No. 5,245,302, each of which is assigned to the current assignee and incorporated herein by reference.

Figure 3:
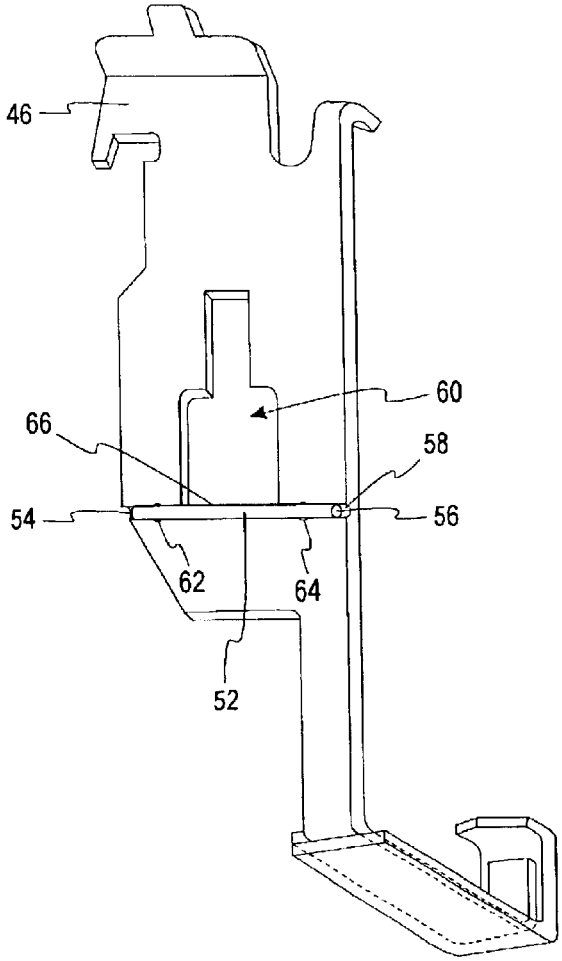
FIG. 3 is a front perspective view of an armature including a latching arrangement embodying the present invention.
Figure 4:
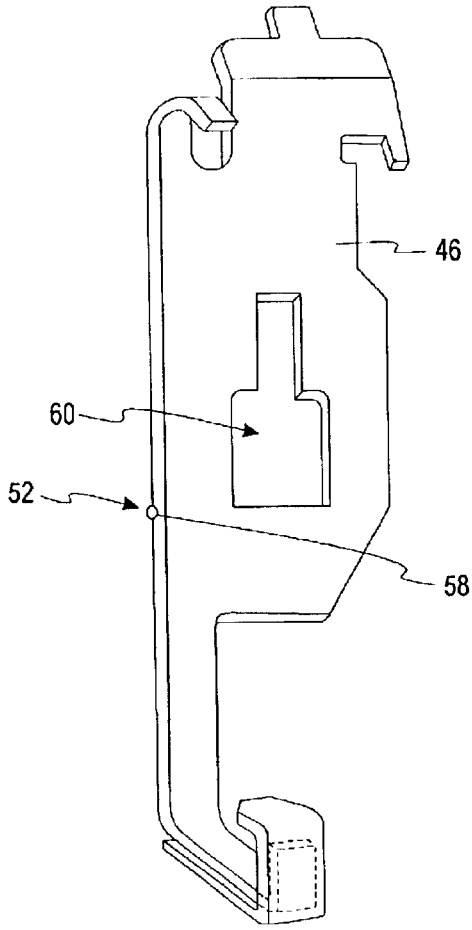
FIG. 4 is a back perspective view of the armature of FIG. 3.

Referring now to FIGS. 3 and 4, the improved latch arrangement will be described in more detail. The armature 46 needs to have magnetic characteristics, and magnetic materials are generally relatively soft metals such as soft steel; however, a hard metal latch surface is required for the proper operation of the trip lever 42. Without the use of the hard metal latch surface, the trip lever 42 could cause indentations damaging the armature 46 and, consequently, the circuit breaker. Therefore, a latch arrangement, comprising the armature 46 and means providing a relatively hard latch surface 52 of minimal surface area, provides a hard metal interface between the trip lever 42 and the armature 46.

The latch 52 has a generally cylindrical shape, and it has a first end 54 and a second end 56. Note that although the term wire is used hereinafter to describe the latch 52, the term is used in a generic sense and it is meant to include a wire, a rod, a pin, a shaft, or any other relatively thin, elongated, generally straight, rigid piece of metal or other solid material of the specified hardness. The generally cylindrical shape helps to improve the repeatability and consistency of installing the wire latch 52 on the armature 46. For example, a circular shape does not have any positioning problems as would arise in a rectangular shape because the circular shape does not contain any sides or corners. Wherein the positioning of the rectangular shape might require an extra step of locating a particular side or corner, the positioning of the circular shape does not require such a locating step. However, in other embodiments of the present invention, the wire latch 52 can have a rectangular, square, or any other non-cylindrical shape if other factors outweigh the positioning problems associated with such shapes. For example, if the cost of a rectangular wire stock is lower than the cost of a cylindrical wire stock, then it may be more beneficial to use the rectangular wire stock.

A method of making the wire latch 52 is to obtain a stock of commercially available wire, which in general is less expensive than flat stock, and then, to produce the wire latch 52 by using a simple feed and cut operation. This method is time and cost efficient, keeping the manufacturing costs low and the manufacturing operations simplified. Another method of making the wire latch 52 is to obtain pins of a desired dimension that are already cut to size, or that can be cut to size using a similar feed and cut operation as mentioned above. As mentioned above, one factor relevant to the present invention is the hardness of the wire. A hard material or a hard coating is preferred to ensure endurance and consistent operation of the circuit breaker. For example, in some embodiments the wire latch 52 may be made of stainless steel. In other embodiments, the wire latch 52 can have a hard coating such as provided by nitro carburizing.

The wire latch 52 is affixed to the armature 46, for example, by welding a first wire end 54 and a second wire end 56 to a groove 58, which is located proximate an opening 60 on a receiving surface of the armature 46. The receiving surface is the surface facing the trip lever 42. The groove 58 has two ends, and is large enough to accommodate the first wire end 54 and the second wire end 56, as well as any welding material. The groove 58 is formed across the entire width of the armature 46 with the groove ends being open. In another embodiment, the groove 58 is formed across part of the width of the armature 46. At least a first weld 62 and a second weld 64 are made to secure the first and second wire ends 54, 56 to the groove 58. To avoid high stress concentration, the location of each of the first and second welds 62, 64 is such that they do not contact any surface of the opening 60 In other embodiments any number of welds in any number of locations can be used. Other methods of affixing the wire latch 52 to the armature 46 can be used, such as soldering, gluing, or press-fitting. In another embodiment, the groove 58 can be formed across part of the width of the armature 46, having the groove ends closed (not shown). In another embodiment, the wire latch 52 can be affixed to the armature 46 by placing the wire latch 52 in a hole that has at least one end open, the hole being drilled in the same general direction as the groove 58. The wire latch 52 can be inserted in the hole through one side, and then the open hole side can be closed using solid material, such as a plug.

While the trip lever 42 is in the latched position it rests against a contact surface 66 of the wire latch 52 and it protrudes, in part, inside the opening 60. Although the opening 60 is shown as a through opening, such as an aperture, in another embodiment it can be a blind opening, such as a depression. As the trip lever 42 moves from the latched position to the tripped position, and vice-versa, it slides across the contact surface 66, which is the interface to the trip lever 42. To reduce frictional forces created during these motions, a friction-reducing lubricant, such as grease, is applied to at least a part of the wire latch 52.

The interruption of the current flow in the circuit breaker, i.e., a short circuit, can cause the forming of debris, which is sometimes moved by the trip lever 42. The forming of debris can also be caused by toggling the handle 44. However, the amount of debris caused by toggling the handle 44 is considerably lower than the amount of debris caused by a short circuit. In prior art devices that use a plate latch, which is usually greased or lubricated, the debris causes the circuit breaker to operate inefficiently or to malfunction. Specifically, the trip lever 42 moves the debris, and the debris gets caught in the grease applied to the plate's latching surface. Then, the debris gets lodged between the trip lever 42 and the latching surface of the latch plate, causing higher than normal tripping and resetting forces. In the present invention, the reduced latching surface of a wire reduces or eliminates this problem. Specifically, the trip lever 42, in addition to its other functions, acts like a cleaning device by pushing the debris out of the way during its movement between the latched and the tripped positions. Because the contact surface 66 is relatively small as compared to the contact surface of a plate, the debris is pushed aside and it does not get lodged between the trip lever 42 and the contact surface 66. Consequently, the wire latch 52 provides generally consistent latching and tripping forces during the service of the circuit breaker.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An electrical device, comprising:

a stationary contact and a movable contact;

a trip lever releasable from a latched position for movement to a tripped position to cause separation of the stationary contact and the movable contact;

a bimetal;

a magnetic armature having a receiving surface with an opening for engaging the trip lever, the armature being connected to the bimetal, the armature moving a predetermined distance in response to a predetermined current flowing through the bimetal to cause the movement of the trip lever to the tripped position; and a rod-shaped latch having a hardened latch surface, the latch having two ends, the latch being positioned proximate the opening for holding the trip lever in the latched position, the latch providing a latching force during the operation of the electrical device.

2. The electrical device of claim 1, wherein the electrical device is a circuit breaker.

3. The electrical device of claim 1, wherein the electrical device is a switch.

4. The electrical device of claim 1, wherein the latch has a grease coating for reducing friction between the trip lever and the latch.

5. The electrical device of claim 1, wherein the latch has a nitro carburized coating for providing a hard contact surface between the wire latch and the trip lever.

6. The electrical device of claim 1, wherein the armature further comprises a groove for locating at least one of the latch ends.

7. The electrical device of claim 1, wherein the armature further comprises at least one hole for locating at least one of the latch ends, the at least one hole being located proximate the opening of the armature.

8. The electrical device of claim 1, wherein the latch has a generally cylindrical shape.

9. The electrical device of claim 1, wherein the latch is made of stainless steel.

10. The electrical device of claim 1, wherein the opening is an aperture.

11. The electrical device of claim 1, wherein the opening is a depression.

12. The electrical device of claim 1, wherein the latch is a wire.

13. A circuit breaker for interrupting the flow of current, comprising:

a housing including a base and a cover;

a stationary contact attached to the base;

a blade attached to the base having a movable contact, the movable contact being movable into and out of engagement with the stationary contact;

a releasably latchable trip lever pivotally mounted in the housing and releasable from a latched position for movement to a tripped position to cause separation of the stationary and movable contacts;

a bimetal mounted in the housing for causing the release of the trip lever from the latched position;

a magnetic armature pivotally connected to the bimetal, the armature having opening for engaging the trip lever, the armature being drawn a predetermined distance in response to a predetermined short circuit current flowing through the bimetal to cause the movement of the trip lever to the tripped position; and a rod-shaped latch having a hardened latch surface positioned near the opening for holding the trip lever in the latched position, the latch providing a latching force during the operation of the circuit breaker.

14. A method for interrupting the flow of current in an electrical device, comprising:

mounting a blade having a movable contact, for movement of the movable contact into and out of engagement with a stationary contact;

pivotally mounting a releasably latchable trip lever relative to the blade such that the trip lever is releasable from a latched position for movement to a tripped position, to cause separation of the stationary and movable contacts;

positioning a bimetal for causing the release of the trip lever from the latched position;

pivotally connecting a magnetic armature to the bimetal, the armature having an opening for engaging the trip lever; and positioning a rod-shaped latch having a hardened latch surface proximate the opening for holding the trip lever in the latched position, the latch providing a latching force during the operation of the electrical device.

15. The method of claim 14, further comprising applying a grease coating to the latch for reducing friction between the trip lever and the wire latch.

16. The method of claim 14, further comprising nitro carburizing the latch for hardening the latching surface.

17. The method of claim 14, further comprising forming the latch from commercially available wire, the wire being cut to the appropriate size.

18. The method of claim 14, further comprising forming the latch from stainless steel wire.

19. The method of claim 14, further comprising forming the latch from a generally cylindrically-shaped material.

20. The method of claim 14, further comprising making a groove proximate the opening for locating the latch.

21. The method of claim 14, further comprising making at least one hole proximate the opening for locating the latch.

* * * * *